US008256491B2

(12) United States Patent
Birkkjær

(10) Patent No.: US 8,256,491 B2
(45) Date of Patent: Sep. 4, 2012

(54) BRACKET MEMBER AND A COUPLING MEMBER FOR SUPPORTING A SCREENING DEVICE IN A WINDOW OR DOOR FRAME, A WINDOW OR DOOR AND A SCREENING DEVICE

(75) Inventor: Martin Birkkjær, Esbjerg (DK)

(73) Assignee: VKR Holding A/S, Hørsholm (DK)

( * ) Notice: Subject to any disclaimer, the term of this patent is extended or adjusted under 35 U.S.C. 154(b) by 0 days.

(21) Appl. No.: 13/137,838

(22) Filed: Sep. 16, 2011

(65) Prior Publication Data

US 2012/0008301 A1 Jan. 12, 2012

Related U.S. Application Data

(62) Division of application No. 12/225,668, filed on Sep. 26, 2008, now Pat. No. 8,051,891.

(51) Int. Cl.
*E06B 9/17* (2006.01)
*A47H 1/10* (2006.01)

(52) U.S. Cl. ..... 160/323.1; 160/903

(58) Field of Classification Search ..... 160/323.1, 160/23.1, 24, 34, 168.1 P, 178.1 R, 181, 188, 160/310, 902, 903; 439/660
See application file for complete search history.

(56) References Cited

U.S. PATENT DOCUMENTS

| | | | |
|---|---|---|---|
| 4,225,814 | A | 9/1980 | Gantz et al. |
| D300,214 | S | 3/1989 | Adams |
| 5,997,318 | A | 12/1999 | Chou |
| 6,049,725 | A | 4/2000 | Emmert et al. |
| 6,273,173 | B1 | 8/2001 | Lassen |
| 6,283,427 | B1 | 9/2001 | Møller et al. |
| 6,550,733 | B1 | 4/2003 | Lassen et al. |
| 6,929,049 | B2 | 8/2005 | Nicolosi |
| 2002/0195991 | A1 | 12/2002 | Son |
| 2003/0201753 | A1 | 10/2003 | Kinoshita |
| 2004/0020606 | A1 | 2/2004 | Nicolosi |
| 2006/0089178 | A1 | 4/2006 | Sakata et al. |

FOREIGN PATENT DOCUMENTS

| | | |
|---|---|---|
| DE | 29 06 088 | 8/1980 |
| EP | 0 728 904 A1 | 8/1996 |
| EP | 1 003 953 B1 | 11/2001 |
| EP | 1 151 176 B1 | 4/2003 |
| EP | 1 365 101 A2 | 11/2003 |
| EP | 1 612 352 A2 | 1/2006 |
| FR | 2 826 517 | 12/2002 |
| WO | WO 85/02646 | 6/1985 |
| WO | WO 99/07974 | 2/1999 |
| WO | WO 99/28581 | 6/1999 |
| WO | WO 2005/008013 A1 | 1/2005 |

*Primary Examiner* — Blair M Johnson
*Assistant Examiner* — Jaime F Cardenas-Garcia
(74) *Attorney, Agent, or Firm* — Merek, Blackmon & Voorhees, LLC

(57) ABSTRACT

A screening device for mounting in a frame structure, which has at least one pair of opposed frame pieces, has two opposite ends and carries at each end a coupling member for supporting the screening device in the frame structure, wherein at least one of said coupling members has a recess having at least one coupling member engagement side for engaging a bracket member in a frame structure and an electrical terminal in the recess. The electrical terminal is resilient and movable in directions towards and away from a body part of the screening device, and the resilience of the electrical terminal is configured so that retaining of the coupling member on the bracket member may, at least in part, be fulfilled by the resilience of the resilient electrical terminal.

6 Claims, 6 Drawing Sheets

BRACKET MEMBER AND A COUPLING MEMBER FOR SUPPORTING A SCREENING DEVICE IN A WINDOW OR DOOR FRAME, A WINDOW OR DOOR AND A SCREENING DEVICE

CROSS-REFERENCE TO RELATED APPLICATION

This application is a division of prior application Ser. No. 12/225,668, filed Sep. 26, 2008 now U.S. Pat. No. 8,051,891.

BACKGROUND OF THE INVENTION

The present invention relates generally to supporting means for supporting a screening device in a frame structure, which has at least one pair of opposed frame pieces, said supporting means comprising a pair of bracket members provided for mounting on a respective frame piece of said pair of opposed frame pieces and a pair of coupling members positioned at either of two opposing ends of the screening device.

More specifically the invention relates to a bracket member and a coupling member of such supporting means, a window or a door provided with a pair of bracket members and a screening device provided with a pair of coupling members. The screening device may be an electric device.

Supporting means for screening devices are known from e.g. EP-A-1 003 953, EP-A-1 151 176 and WO-A-2005/008013.

The general idea disclosed in these documents is to provide a pair of standardized bracket members on two opposite frame pieces of e.g. a window to provide for subsequent mounting a screening device in according with the desire of a user of the window. The screening device may e.g. be a roller curtain, a Venetian blind, a roller shade or a pleated curtain. The screening device should on the other hand be provided with coupling members provided for cooperation with the bracket members.

The bracket members are preferably minor flat elements, which may be mounted by the window manufacturer, without their presence disturbing the overall appearance of the window in case no screening device is mounted.

Thus each bracket member comprises a base for abutment on the frame piece, a main face opposite the base and at least one outer engagement side, preferably two mutually opposite, outer engagement sides, for engaging a coupling member of the screening device. In most embodiments shown in the documents mentioned, two parallel, opposite outer engagement sides are present on the bracket member for cooperating with two opposite, parallel inner engagement sides on the coupling member. However EP-A-1 151 176 discloses also embodiments in which only one outer engagement side of the bracket member is used, the bracket member being mounted so close to a third frame piece of the window (or door) that this third frame piece fulfills the function of the second outer engagement side.

The features of the known supporting means mentioned so far are generally applicable to the present invention.

The mentioned documents generally relate to the mounting of manual operated devices, i.e. non-electric devices, but EP-A-1 003 953 does suggest an embodiment in which a zone of the main face of a bracket member is made of an electrically conducting material and a wall part of a corresponding coupling member likewise comprises a zone of an electrically conductive material to provide for connecting an electric power source to an electric screening device. It is however for different reasons not desirable to make parts of the main face of an electrically conducting material, said main face being always exposed if no screening device is mounted.

SUMMARY OF THE INVENTION

The object of the present invention is to provide an alternative for a supporting means of the mentioned kind, which provides for connecting an electric screening device with an electric power source.

Thus according to the invention a bracket member is provided said bracket member comprising a base for abutment on the frame piece, a main face opposite the base and at least one bracket member engagement side, preferably two mutually opposite, bracket member engagement sides, for engaging a coupling member of the screening device, wherein a part of the main face is provided by a releasable cover member, and wherein below the cover member an electrical contact point is provided, It is thus obtained that when not in use the electrical contact point is hidden beneath the cover member, which on the other hand may provide protection for the electrical contact point, and also the cover member may provide an aesthetic appearance to the bracket member. The presence of the electrical contact point below the cover member furthermore ensures that the distance between the two bracket members situated on opposite frame pieces is at least not reduced to provide for electric connection with a screening device. This would be the case in a design comprising an intermediate electric connection piece to be connected with the bracket members to provide for electric connection with a screening device. Such a solution would in turn cause problems when mounting an arbitrary screening device.

Preferably two electrical contact points are provided below the cover member. Thereby only one of a pair of brackets needs to provide with contact points and corresponding electric wiring.

In a preferred embodiment a central strip of the main face is provided by the cover member, and at least one lateral strip of the main face, adjacent the central strip, is in a fixed mutual relationship with the adjacent bracket member engagement side. When two opposite bracket member engagement sides are provided lateral strips of the main face on either side of the central strip are in fixed mutual relationship with respective bracket member engagement sides. Thereby a part or parts of the main face, namely the lateral strips, will keep their position when the cover is removed, and thus the distance between these parts of two opposite bracket members mounted in a frame structure, such as a window or a door frame, will remain unchanged when the cover(s) is (are) removed. Further it is obtained that the engagement between the bracket member and the corresponding coupling member is not affected by the presence of the cover member. Thereby the engaging parts of a coupling member need not be changed in accordance with manufacture of coupling members for electric or non-electric screening devices, which lowers overall manufacturing costs.

In a practical embodiment a pin is extending from the base, said pin comprising an electrical terminal connected to the electrical contact point. This provides for connecting electric wiring to the contact point. The pin may comprise two terminals connected with respective electrical contact points, when two such points are present.

Preferably the electrical contact point is positioned in a recess below the cover member.

In a practical embodiment the bracket member has a direction of insertion when mounting a screening device, said direction being parallel to the at least one bracket member engagement side, the two electrical contact points being positioned in respective recesses placed in a side-by-side relationship relative to the direction of insertion.

According to the invention a coupling member is provided, said coupling member comprising a recess having at least one coupling member engagement side for engaging a bracket member and an electrical terminal in the recess. Preferably the electrical terminal is protruding in the recess. Preferably two opposite coupling member engagement sides for engaging a bracket member are provided, and the electrical terminal preferably protrudes between said coupling member engagement sides. The shape of the recess may correspond to the shape including the cover member of a bracket member, with which the coupling member is intended to cooperate. By letting the terminal protrude in the recess the terminal may engage the electrical contact point of the bracket when the cover member is removed.

Preferably the electrical terminal is resilient and movable in directions towards and away from a body part of the screening device.

In a further preferred embodiment the electrical terminal is provided with an inclined surface providing for the electrical terminal to yieldingly ride over a raised surface in a bracket member during mounting or dismounting a screening device. This embodiment is suited for cooperation with a bracket member wherein the electrical contact point is positioned in a recess below the cover member, because the inclined surface of the terminal will facilitate the terminal riding over the part of the bracket surrounding the recess below the cover member.

In a practical embodiment the coupling member has a direction of insertion when mounting a screening device, said direction being parallel to the at least one coupling member engagement side, two electrical terminals being placed in a side-by-side relationship relative to the direction of insertion.

According to the invention a window or a door may be provided with a pair of bracket members at least one of which is provided in accordance with the present invention, and also according to the invention a screening device for mounting in a frame structure, such as a structure of a window or a door, is provided with a pair of coupling members at least one of which is provided in accordance with the present invention.

BRIEF DESCRIPTION OF THE DRAWINGS

The invention will be explained in further detail in the following with reference to the accompanying schematic drawings, on which

DETAILED DESCRIPTION OF THE PREFERRED EMBODIMENTS

Figure 1:
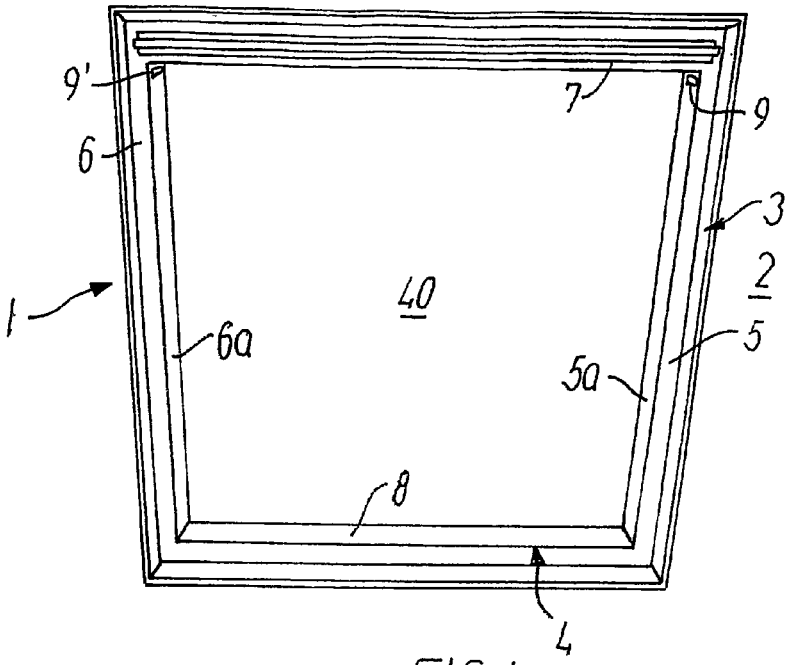
FIG. 1 shows a window.

FIG. 1 shows a window 1 mounted in a wall or a pitched roof 2. The window is seen from the inside of a room under the roof 2. In the embodiment shown, the window comprises a window frame 3 and a sash 4 connected to the window frame 3 by a pivot having a horizontal pivot axis close to the center of the window 1. The sash 4 comprises a frame structure with two lateral frame pieces 5 and 6 interconnected by a top frame piece 7 and a bottom frame piece 8. On opposite inner lateral sides 5*a*, 6*a* of the two lateral frame pieces 5 and 6 bracket members 9 and 9' are provided, respectively.

Figure 2:
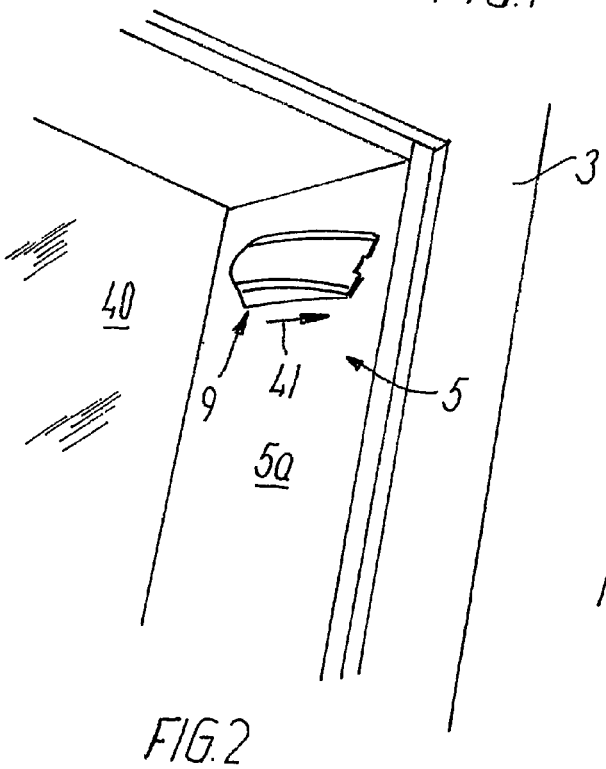
FIG. 2 is a perspective view of a detail of the window in FIG. 1.
Figure 3:
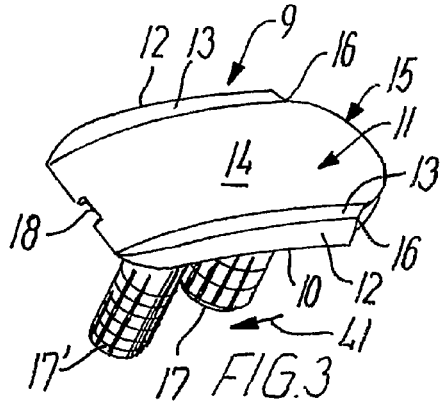
FIG. 3 is a perspective view from above of a bracket member of the present invention.

FIG. 2 shows a closer detail of the window 1 around the bracket member 9 on the lateral frame piece 5.

The bracket member 9 will now be described in detail with reference to FIGS. 3-6. The outer shape of the bracket member 9 is generally known from the above mentioned WO-A-2005/008013, FIG. 2, and it has a base 10 for abutting on the frame piece 5 and a generally flat, smooth main surface 11 opposite the base 10. In the embodiment shown, the base 10 and the main surface 11 are interconnected by two, mutually parallel, outer bracket member engagement sides 12. Two lateral strips 13 of the main surface 11 are integral with the outer engagement sides 12 to be in a fixed mutual relationship therewith, but the major part, a central strip 14, of the main surface 11 is provided by a cover member 15. Shoulders 16 are integral with the lateral strips 13 and the outer engagement sides 12. From the base 10 pins 17 and 17' are extending for mounting of the bracket member 9 by insertion of the pins 17, 17' in holes in the frame piece 5. At an end of the bracket member 9 intended to be closest to the room the engagement sides 12 are tapered and the main surface 11 is rounded to meet the base 10. A recess 18 in a front edge of the cover member 15 is provided for insertion of a tool to lift off the cover member 15. It is noted that the bracket member engagement sides may take any suitable form, as long as a safe engagement between the bracket members and coupling members of a screening device is provided for. For instance, there may be only one engagement side situated on the outer side of the bracket member 9. Alternatively, or additionally, the engagement sides may be formed as tracks on the main surface cooperating with rails in the coupling member of the screening device (to be described herein below), or vice versa. Furthermore, the engagement sides need not to be continuous or extend throughout the entire height of the bracket member.

Figure 5:
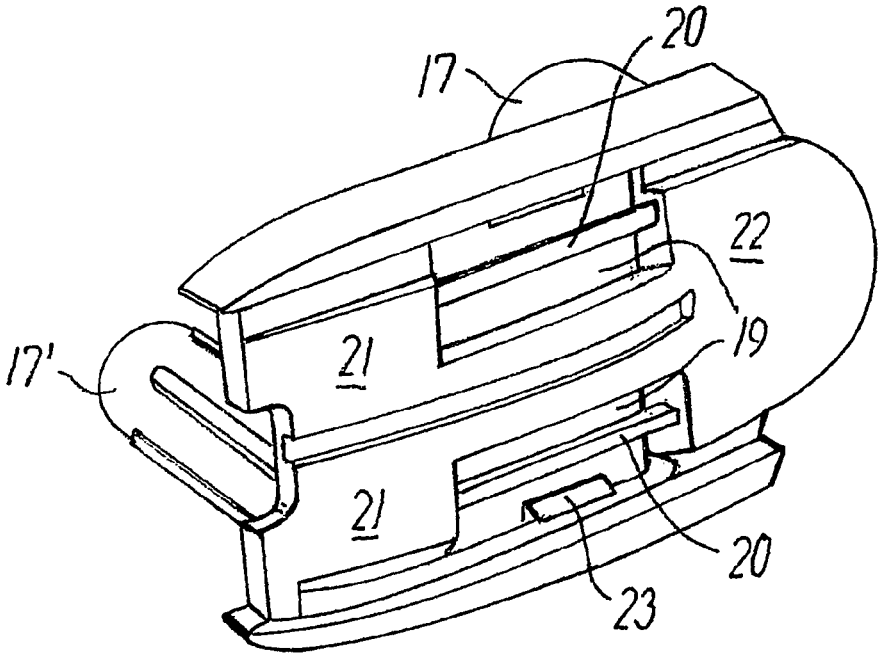
FIG. 5 is another perspective view from above of the bracket member of FIG. 3 a cover member having been removed.

FIG. 5 shows a lower part of the bracket member 9 without the cover member 15. As it appears two recesses 19 are provided side-by-side below the cover member and inside each recess 19 an electrical contact point provided by a metal bar 20 is present. The recesses 19 are bordered by raised surfaces 21, 22. In the recesses 19 ribs 23 are provided for engagement with the cover member 15. The contact point or points of the bracket member 9 may, in principle, assume any suitable form as long as a reliable electrical connection is obtained. For instance, 5 the contact point could be situated on one or both of the inner sides of the bracket member to extend substantially perpendicularly to the base 10.

Figure 4:
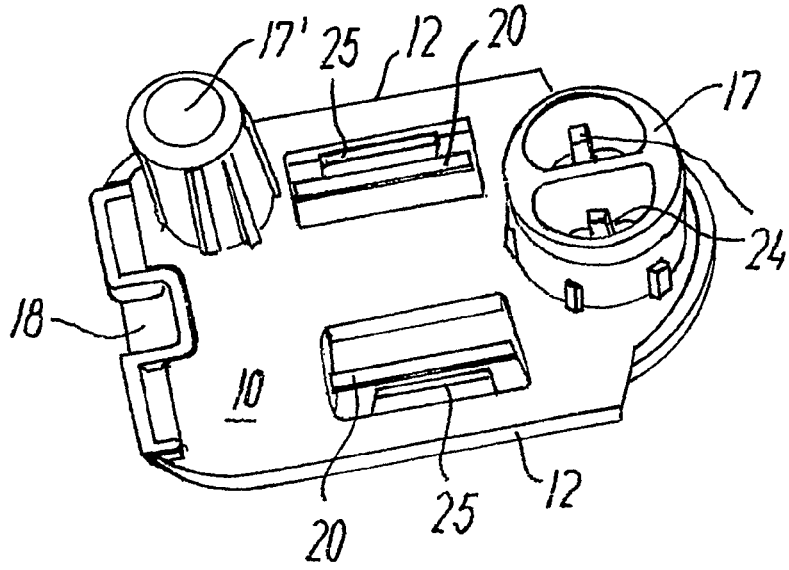
FIG. 4 is a perspective view from below of the bracket member of FIG. 3.

As seen in FIG. 4 the pin 17 comprises two hollows in either of which an electrical terminal 24 is provided as plugs. The two electrical terminals 24 are connected to a respective metal bar 20.

Figure 6:
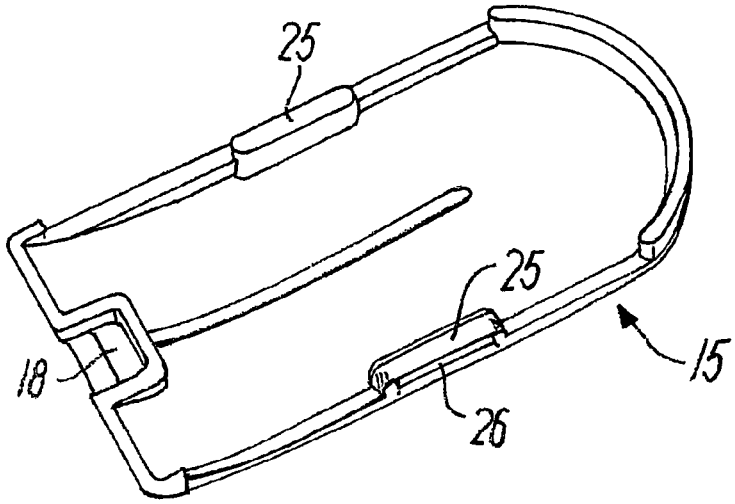
FIG. 6 is a perspective view from below of the cover member.

FIG. 6 shows the cover member 15 from below and it is seen that the cover member comprises fishplates 25 with depressions 26 for engagement with the ribs 23 when the cover member 15 is attached to the lower part of the bracket member 9.

Figure 7:
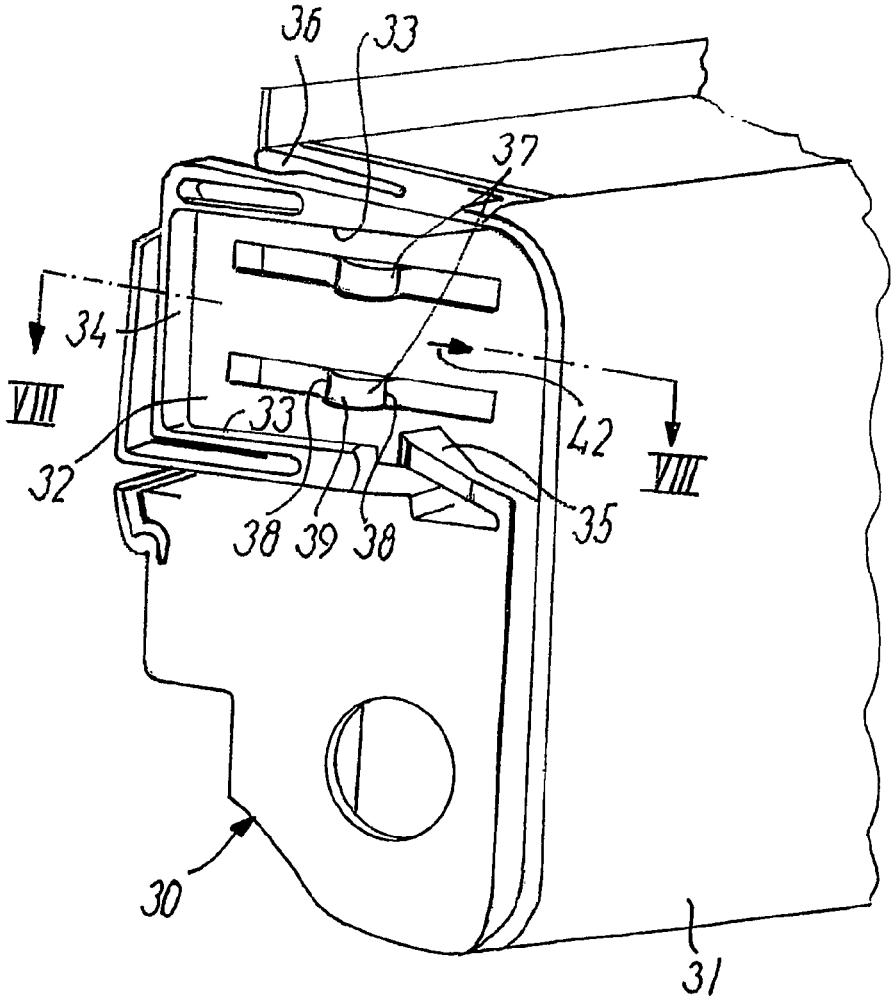
FIG. 7 is a perspective end view of a screening device provided with a coupling member according to the invention.
Figure 8:
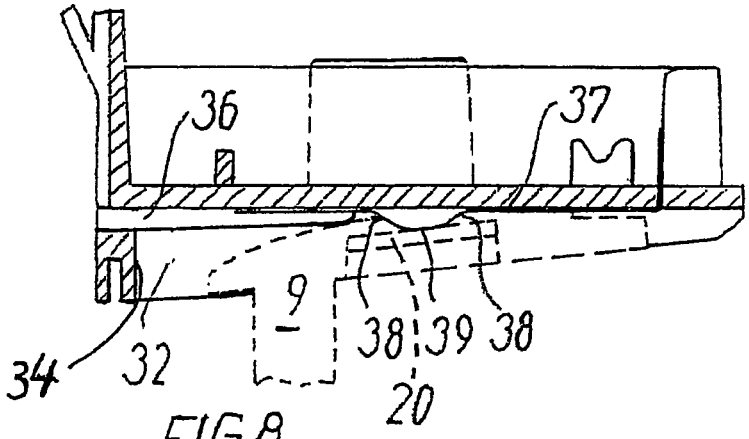
FIG. 8 shows a section along line VIII-VIII in FIG. 7.

FIGS. 7 and 8 shows a coupling member 30 provided for engagement with the bracket member 9. The coupling member 9 is mounted at an end of a body part 31, e.g. housing, of a screening device. The coupling member 30 comprises a recess 32 having two, mutually opposite, inner coupling member engagement sides 33 for engaging with a play the two outer engagement sides 12 of the bracket member 9. The play provides for a loose fit between the bracket member and the coupling member for easy mounting. The recess 32 has an end wall 34 interconnecting the inner engagement sides 33, whereas the recess 32 is open opposite the end wall 34 for receiving the bracket member 9 when mounting the screening device in the window 1.

The coupling member 30 comprises adjacent one of the inner engagement sides 33 a flexible latch member 35 for engaging a respective one of the shoulders 16 of the bracket member 9, when mounting the screening device.

A slot 36 separates the end wall 34 and parts of the inner engagement sides 33 from the major part of the coupling member 30 whereby the separated parts may be flexed a little towards said major part to compensate for tolerances between the lateral frame pieces 5 and 6 when mounting the screening device.

In the recess 32, i.e. between the inner engagement sides 33, the coupling member 30 is provided with two electrical terminals 37 made from resilient metal strips. The metal strips are bent to have inclined surfaces 38 and an apex 39 between the latter. In this manner the electrical terminals 37 protrude in the recess 32, extending in the direction away from the body part 31 of the screening device, substantially in parallel with the inner engagement sides 33. Obviously, this design is intended for cooperation with the particular embodiment of the metal bars 20 constituting the contact points forming part of the electrical connection of the bracket member 9. In case the contact points of the bracket member are designed in a different manner, for instance as described in the above description of FIG. 5, the electrical terminals would protrude in a direction substantially perpendicularly to the inner engagement sides 33. The electrical connection may be formed in any suitable manner, and need not necessarily include metal elements but may be formed by composite elements such as electrically conducting plastic materials.

When mounting the screening device it is held in a position in front of the bracket members 9, 9' on the window frame pieces 5, 6.

From this position the screening device is moved in a direction of insertion substantially perpendicular to the plane of a pane 40 of the window 1. Thereby the bracket member 9 obtains a relative direction of insertion 41 and the coupling member obtains a relative direction of insertion 42, the relative directions of insertion 41, 42 being parallel to their respective engagement sides 12, 33. During insertion the inclined surfaces 38 of the resilient metal strip will provide for the electrical terminals 37 and especially the apexes 39 to flex in a direction towards the body part 31 and ride over the raised surfaces 21 adjacent the recesses 19 in the bracket member 9 where after the metal strips will flex back and the apexes 39 will contact the metal bars 20 to provide for electrical connection between the bracket member 9 and the coupling member 30. The function of retaining the coupling member on the bracket member may, at least in part, be fulfilled by the resilience, i.e. the springing quality, of the contact between the electrical terminals 37 and metal bars 20. In this manner, the flexible latch member 35 may be superfluous. Furthermore, some tolerances may be compensated for by the resilience, thus reducing the demands to the resilience of the remaining parts of the coupling member.

Together bracket members 9, 91 and coupling members 30 provide a supporting means for the screening device.

The bracket member 9 needs wiring to be able to provide the coupling member with electric power.

Figure 9:
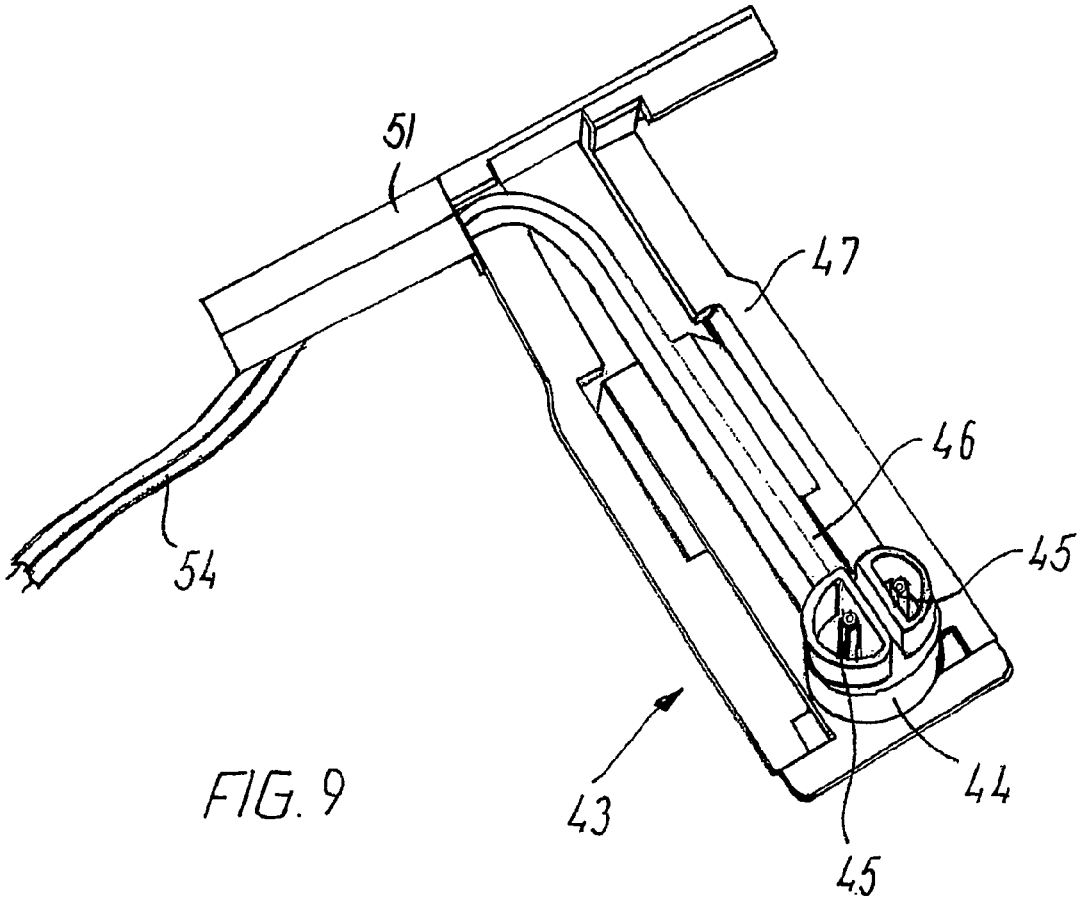
FIG. 9 is a front view of a guide-and-socket member.
Figure 12:
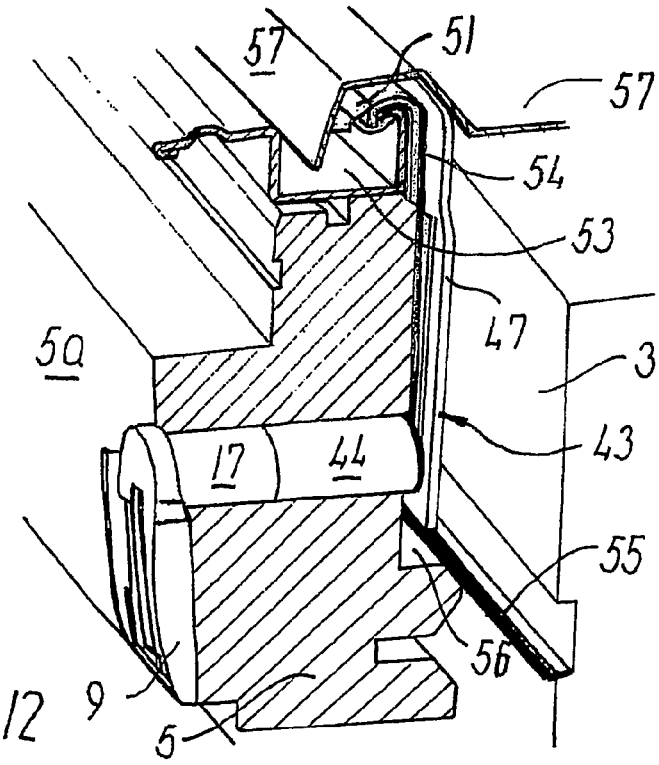
FIG. 12 shows a partial section of the window.
Figure 10:
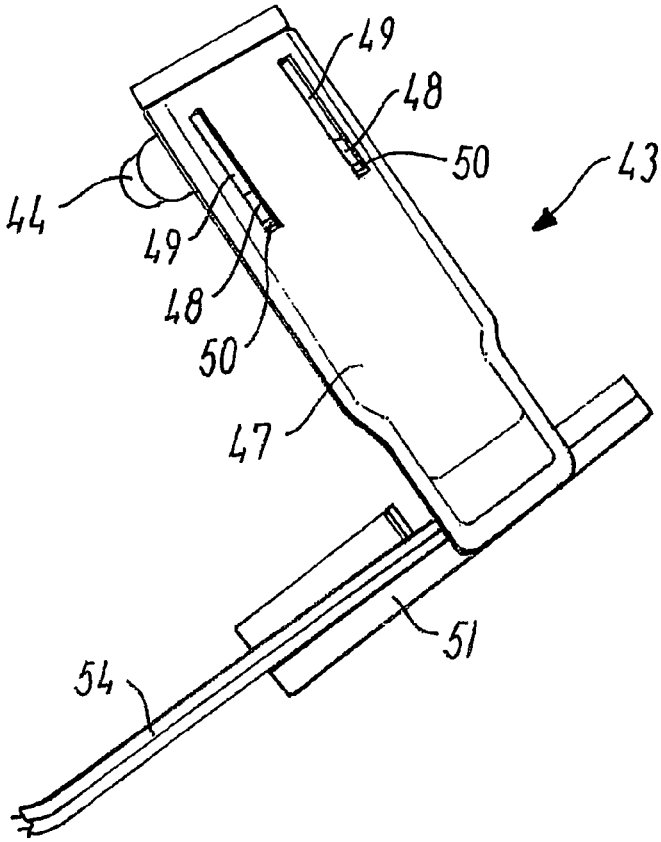
FIG. 10 is a back view of the guide-and-socket member of FIG. 9.
Figure 11:
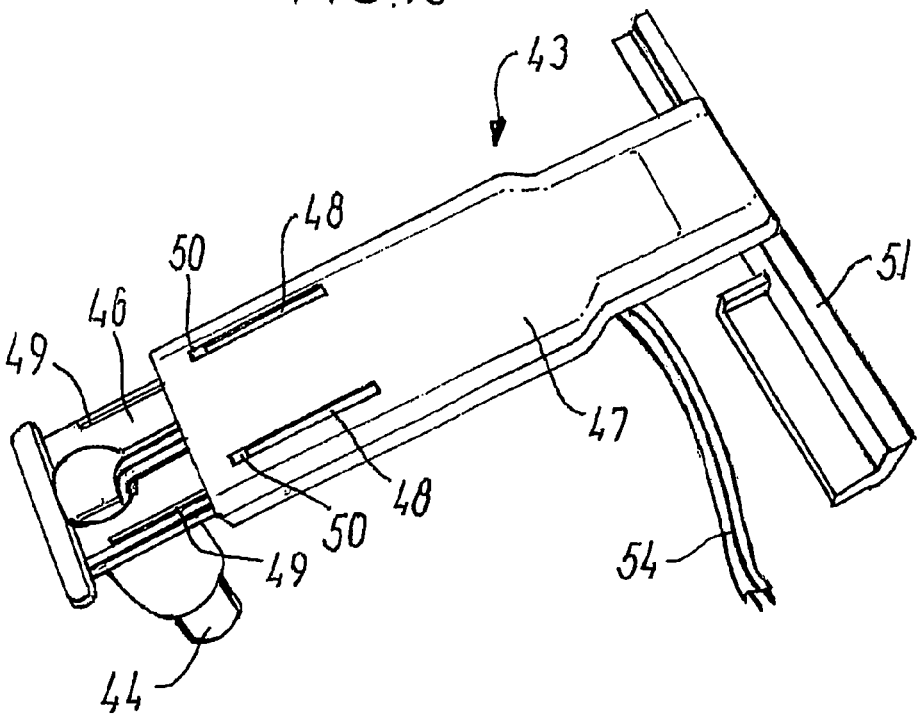
FIG. 11 is a back view of the same guide-and-socket member in an extended position.

To this end a guide-and-socket member 43 is provided as shown in FIGS. 9-11. FIG. 12 shows the guide-and-socket member 43 in a build-in position. The guide-and-socket member 43 comprises a pin 44 with sockets 45 for plugging in the plug-shaped terminals 24 of the pin 17 of the bracket member 9. Obviously, the terminals 24 may be formed as sockets and the sockets 45 as plugs, or in any other suitable manner ensuring good electrical contact. The pin 44 extends from flat inner telescoping piece 46, which is attached to an outer telescoping piece 47. The two telescoping pieces may be telescoped between two mutual positions as shown in FIGS. 10 and 11, respectively. Slots 48 in the outer telescoping piece 47 are receiving ribs 49 and knobs 50 on the inner telescoping piece 46 to retain the telescoping pieces in the two mutual positions mentioned. Due to flexibility of the material, from which the guide-and socket member 43 is made, the ribs 49 may be disengaged from the respective slots 48 to facilitate a telescoping movement between the two mutual positions mentioned. Opposite the pin 44 the outer telescoping piece 47 is provided with a transverse catching-and-guiding piece 51.

FIG. 12 shows a cross-section of the lateral frame piece 5 of the sash 4 of the window 1, which is in a closed position the lateral frame piece 5 lying adjacent the window frame 3. The bracket member 9 is placed on the inner lateral side 5*a*, the guide and socket member 43 is placed on an opposite outer lateral side 5*b*, the pins 17 and 44 extending through a hole in the lateral frame piece 5 and being plugged together. A glazing bead 53, preferably made of metal, is provided on the outside of the lateral frame piece 5, the pane being omitted from FIG. 12 for sake of clarity. A wire 54 is extending from the sockets 45, through the pin 44, along the telescoping pieces 46, 47 to the catching-and-guiding piece 51, which on one hand catches the glazing bead 53 and on the other hand guides the wire 54 along said glazing bead 53. The adjacent part of the window frame 3 is provided with a sealing strip 55 for sealing abutment against a sealing surface 56 on the lateral frame piece 5. To avoid friction between the sealing strip 55 and the outside of the outer telescoping piece 47, when opening and closing the window, said outside is smooth and preferably slippery. The smooth, possibly slippery, properties may be obtained in any manner known per se. A flashing strip 57 mounted on the window frame 3 covers the joint between the window frame 3 and the lateral frame piece 5 and the wire 54 running along the glazing bead 53, when the window is in the closed position.

In the production line, the wiring is installed in a first step. Subsequently, the glazing bead 53 is mounted, and the guide-and-socket member 43 (without the catching-and-guiding piece 51) is connected with the frame piece in question. When mounting the guide-and-socket member 43 the two telescoping pieces 46, 47 are initially held in the mutual position shown in FIG. 11. When the pin 44 has been plugged in the hole in the lateral frame piece 5 and the telescoping pieces 46, 47 are abutting the outer lateral side 5*b*, the telescoping pieces 46, 47 are telescoped together for the catching-and-guiding piece 51 to catch the glazing bead 53.

Figure 13:
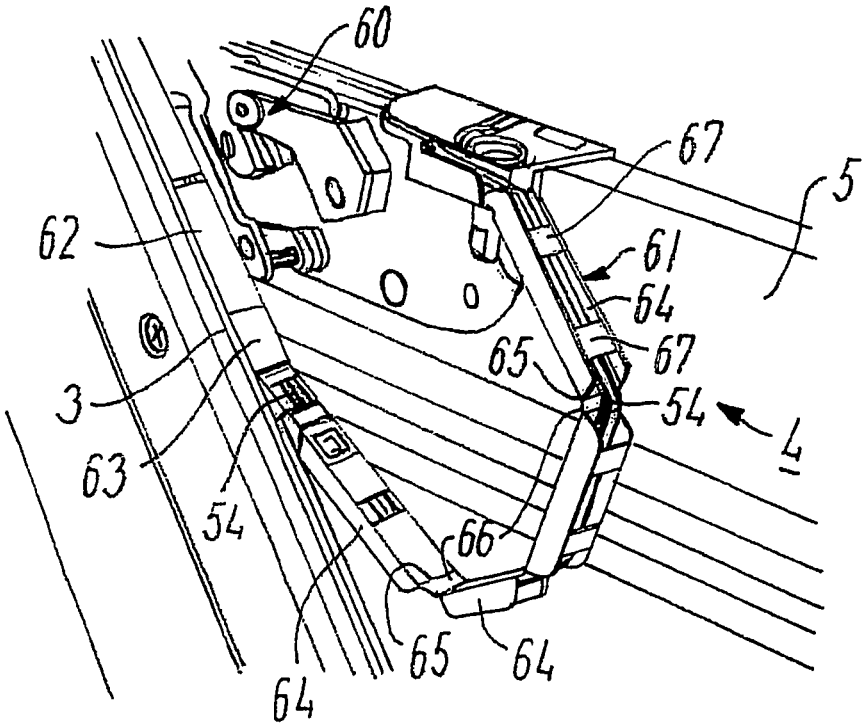
FIG. 13 shows a detail of an open window.

The wire 54 follows the glazing bead 53 to the area around the pivot, cf. FIG. 13, which show the window from the outside. The pivot is provided by a hinge element 60 e.g. of the general kind disclosed e.g. in WO-A-85/02646, WO-A-

99/28581 or EP-A-1 612 352. At the pivot the wire 54 is lead into a protective chain element 61, of a generally known kind, to be guided by the protective chain element 61 to the window frame 3. In order to provide for disassembling the window sash 4 from the window frame 3 a plug-and-socket connection is provided between the end of the protective chain element 61 and the window frame 3 said connection comprising a socket 62 on the window frame 3 and a plug 63 at the end of the protective chain element 61. The chain of the protective chain element 61 comprises sections 64 of a U-shaped cross-section the respective sections being interconnected by thin flexible pieced 65 of material and small connecting pieces 66. The wire 54 is running in the U-shaped sections 64 and is held in place by portions 67 bridging the free ends of the U-shape. The protective chain element provides for movement in a single plane only and thus it prevents the wire 54 from being pinched between the sash 4 and the window frame 3 when the window is closed. The connection may be formed in an arbitrary position along the chain element. The connection itself may form a link section.

The invention should not be regarded as being limited to the embodiments shown and described in the above, but several modifications and combinations may be carried out without departing from the scope of the appended claims. For instance, the frame structure described in connection with a pivotal window may form part of any suitable structure, one example being a top-hung window, another one being a door.

The invention claimed is:

1. A screening device for mounting in a frame structure that has at least one pair of opposed frame pieces, said screening device having a body part and two opposite ends and carrying at each end a coupling member for supporting the screening device in the frame structure, wherein at least one of said coupling members comprises a recess having at least one coupling member engagement side for engaging a bracket member in the frame structure and at least one electrical terminal in the recess, the electrical terminal is resilient and movable in directions towards and away from the body part of the screening device, and the electrical terminal is configured such that said at least one coupling member is retained on the bracket member, at least in part, by the resilience of the resilient electrical terminal, and wherein the at least one electrical terminal is protruding in the recess in a direction away from the body part of the screening device.

2. A screening device according to claim 1, wherein said at least one coupling member has two opposite coupling member engagement sides for engaging a bracket member, the at least one electrical terminal protruding between said coupling member engagement sides.

3. A screening device according to claim 1, wherein the recess has an end wall, and a slot separates the end wall and parts of inner engagement sides of the recess from the body part of said at least one coupling member so that the separated parts can be flexed to compensate for tolerances when mounting the screening device.

4. A screening device according to claim 1, wherein the at least one electrical terminal has an inclined surface enabling the at least one electrical terminal to yieldingly ride over a raised surface in a bracket member during mounting or dismounting of a screening device.

5. A screening device according to claim 1, wherein the screening device is an electric device.

6. A screening device according to claim 1, wherein said at least one coupling member has a direction of insertion when the screening device is being mounted, said direction being parallel to the at least one coupling member engagement side, and said at least one coupling member comprises two of the electrical terminals in the recess, the electrical terminals being in a side-by-side relationship relative to the direction of insertion.

* * * * *